United States Patent [19]

Taylor et al.

[11] Patent Number: 5,027,872

[45] Date of Patent: Jul. 2, 1991

[54] SYSTEM FOR INTRODUCING ADDITIVE INTO A CONTAINER

[75] Inventors: Celia C. Taylor, Slough; Michael R. Cane, Stockton; Fraser Kennedy, Warwick, all of England

[73] Assignee: Imperial Chemical Industries PLC, London, England

[21] Appl. No.: 392,736

[22] Filed: Aug. 11, 1989

[30] Foreign Application Priority Data

Aug. 11, 1988 [GB] United Kingdom ..... 8819101.0

[51] Int. Cl.[5] ..... B65D 25/08

[52] U.S. Cl. ..... 141/347; 141/366; 141/018; 141/329; 206/219; 215/250; 215/258; 215/DIG. 8; 366/605

[58] Field of Search ..... 141/1, 2, 9, 18, 22–28, 141/98, 312, 319–322, 329, 330, 346–357, 363–366, 11; 366/605; 206/219–222; 215/250, 258, 227, DIG. 8; 220/265; 222/541, 80, 386, 402, 401; 401/132–135; 604/82, 85, 87, 262, 416; 101/364; 346/140 PD

[56] References Cited

U.S. PATENT DOCUMENTS

| | | | |
|---|---|---|---|
| 2,311,367 | 2/1943 | Chambers | 141/24 |
| 2,524,607 | 10/1950 | Smith | 206/221 |
| 2,639,838 | 5/1983 | Bierman et al. | 222/402 |
| 2,677,459 | 5/1954 | Ritzenberg | 206/222 |
| 3,327,710 | 6/1967 | Freeberg et al. | 206/222 X |
| 3,347,410 | 11/1967 | Schwartzman | 222/80 |
| 3,369,579 | 2/1968 | Hollowell | 141/364 |
| 3,533,455 | 11/1970 | Randol | 401/134 |
| 3,667,657 | 6/1972 | Chiquiar-Arias | 222/541 |
| 3,709,409 | 1/1973 | Collins | 222/402 |
| 4,186,783 | 2/1980 | Brandt | 141/18 |
| 4,402,432 | 9/1983 | Corsette | 222/401 X |
| 4,419,677 | 12/1983 | Kasugayama et al. | 346/140 PD |
| 4,469,153 | 9/1984 | Morrisette | 141/364 |
| 4,546,363 | 10/1985 | Iwagami | 346/140 PD |
| 4,573,506 | 3/1986 | Paoletti | 141/98 |
| 4,589,000 | 5/1986 | Koto et al. | 346/140 PD |
| 4,650,096 | 3/1987 | Thatcher | 222/541 X |
| 4,712,593 | 12/1987 | Zulauf et al. | 141/357 X |
| 4,798,287 | 1/1989 | Groves et al. | 206/219 |
| 4,821,875 | 4/1989 | Groves et al. | 206/219 |

FOREIGN PATENT DOCUMENTS

| | | | |
|---|---|---|---|
| 2006172 | 5/1979 | United Kingdom . | |
| 2106794 | 4/1983 | United Kingdom | 366/605 |

*Primary Examiner*—Ernest G. Cusick
*Assistant Examiner*—Casey Jacyna
*Attorney, Agent, or Firm*—Cushman, Darby & Cushman

[57] ABSTRACT

A system for introducing flowable additive e.g. colorant from a syringe into paint varnish, woodstain or the like contained in a closed container provided with an inlet into the container which inlet is closed by a closure. The inlet is openable by insertion of the nozzle of the syringe into the inlet which thereby ensures that the nozzle of the syringe is correctly located in the inlet before expulsion of the additive commences.

8 Claims, 5 Drawing Sheets

SYSTEM FOR INTRODUCING ADDITIVE INTO A CONTAINER

BACKGROUND OF THE INVENTION

This invention relates to a system for introducing flowable additive to paint, varnish, woodstain or the like contained in a closed (preferably lidded) container. "Paint" includes traditional paints based on organic solvents and also paints based on aqueous solvents many of which are known as emulsion or latex paints. The additive may be any material which can be caused to flow well enough to enable it to be introduced into the container. The invention especially relates to a system for introducing a dose of (usually liquid or semi-solid) colourant to a base paint contained in a lidded paint can and which system is suitable for use in retail shops or stores which supply tradesmen. Such introduction of colourants into paint in shops or stores is often known as "in-store tinting". In-store tinting allows a much wider range of colours to be offered than would be possible if cans of each individual coloured paint had to be stocked. This is because the space which would be needed to stock a large number of coloured paints is much greater than the space needed to stock cans of base paint and an equivalent number of doses of colourant. Other additives which can be introduced to paint, varnish or woodstain using the system include fungicides, foaming agents, rheology modifiers, components (usually a catalyst or accelerator) of a multi-component paint or varnish or additives which modify the appearance of a paint such as flowable particulate solids such as solids which impart texture to a paint or metal flakes always provided such solids can be made to flow.

Hitherto in-store tinting has usually involved removing the lid from the can (or even punching a hole in the lid), introducing the correct dose or doses of colourant into the can, replacing the lid (or plugging the hole) and finally shaking the can in a mechanical shaker to disperse the colourant. Removal of the lid creates an opportunity for the paint, varnish or woodstain to be spilled or splashed and so this type of tinting technique is generally inconvenient and not very suitable for use by inexperienced people, especially members of the public in self-service shops. Punching a hole in the lid requires the skilled use of a sharp tool and so it is a technique which is quite unsuitable for use by inexperienced people. A further difficulty is that care is needed to ensure that the correct dose of additive is introduced into the container. This is especially so when the additive is a colourant because the eye is very sensitive to variations in shade caused by a failure to add all of the colourant. The amount of care needed can be reduced by supplying measured doses of additive in capsules but even then care is still needed to avoid spillage and splashing. Care is also needed to ensure that a capsule is properly emptied otherwise not all of a measured dose of for example colourant will be introduced into the paint and consequently unacceptable variations in shade may occur.

SUMMARY OF THE INVENTION

One object of this invention is to provide a system which can tolerate a very positive introduction of additive into the closed container but which nevertheless creates little risk of spillage and splashing. An object of a refinement of the invention is to provide a system especially suitable for use by inexperienced members of the public. An object of another refinement is to provide a system which allows a container into which additive has been introduced to be conveniently shaken in a mechanical shaker.

Accordingly this invention provides a system for introducing flowable additive to paint, varnish, woodstain or the like contained in a closed (preferably lidded) container wherein the system comprises a) a syringe containing the additive and having a piston for use in expelling the additive from the syringe and a nozzle through which the additive can be expelled and b) a closed container containing the paint, varnish, woodstain or the like provided with an inlet closed by a closure but which inlet is openable by insertion of the syringe nozzle into the inlet.

The use of the syringe nozzle to open the container inlet ensures that the nozzle is properly located in the inlet before commencement of the very positive introduction of additive which the use of a syringe generates and which might otherwise cause a jet of additive to squirt in unexpected directions. The very positive introduction of additive is needed for an efficient delivery of measured amounts of additive.

Generally the container inlet is openable by an inwards disturbance of its closure in response to an inwards (of the container) force exerted by the insertion of the syringe nozzle into the inlet. The nozzle may disturb the closure for example by displacing it inwardly away from the inlet or by puncturing it. An inwardly displaceable closure may comprise for example a cap or disc snap-fitted or frangibly bonded (preferably by adhesive) to the inlet. A puncturable closure may comprise for example a metal or plastics foil similarly attached to the inlet. A sandwich of metal and plastics foils may be used to combine the strength of the metal with the chemical resistance of the plastics material. The metal may be for example aluminium and the plastics material may be for example polyethylene or ethylene copolymer.

The inlet and the nozzle are preferably dimensioned such that on insertion of the nozzle into the inlet, the clearance between nozzle (when fully inserted) and inlet does not exceed 1.5 mm. Preferably the nozzle should make a press fit into the inlet so as to ensure positive location of the nozzle in the inlet. It is further preferred that the inlet and nozzle be shaped so as to have co-operable resilient snap-fitting means (for example a rib receivable in a groove) so that the nozzle can make a snap fit into the inlet which ensures that the nozzle remains properly located in the inlet at least until introduction of the additive has been completed.

Although many additives for paint are quite viscous and unlikely to escape through the syringe nozzle in the absence of an expelling force exerted by the syringe piston, it is nevertheless preferred to provide the nozzle with a closure for use in storage and transit. The closure may be for example a cap screwed or push-fitted to the nozzle, a puncturable closure of the type described for use with the inlet or a stop frangibly attached to the nozzle. Alternatively the nozzle could have a blind end which is cut from the nozzle (thereby opening the nozzle) just before its insertion into the container inlet. However, a preferred closure comprises a stop frangibly attached to the nozzle by means of a thin web which can be sheared to allow the stop to be displaced so opening the nozzle.

Additive is expelled from the syringe by relative movement of the piston and nozzle towards each other. In order to inhibit unintentional relative movement, it is preferred to link means for moving the piston to means disengageably fixed relative to the nozzle whereby movement of the piston relative to the nozzle is impossible without first disengaging the fixed means. For example the piston may be linked via a piston rod or the like to a member which is disengageably fixed to the syringe chamber which houses the additive and to which the nozzle is also fixed. Various techniques are available to disengageably fix the member to the chamber. For example the member and the chamber may each be provided with one of a pair of co-operating resilient snap-fitting profiles which require the deliberate exertion of a force to cause disengagement. Alternatively the member may be provided with a tear-strip which engages a suitable profile on the chamber but which can be disengaged by tearing away the tear-strip. A further technique involves the use of an adhesive strip stuck onto both the member and the chamber and which can be disengaged by either peeling off the strip or cutting the strip to sever the portion stuck to the member from the portion stuck to the chamber. Preferably the member comprises a sleeve telescopable with the chamber to bring about movement of the piston to expel the additive.

After the additive has been introduced into the container, it is usually necessary to disperse the additive in the paint or the like by shaking the container and this in turn requires that the container inlet be sealed in some way. The simplest way to do this is to withdraw the nozzle from the inlet and then to insert a press or snap-fit resilient stopper into the inlet. Withdrawal of the nozzle from the inlet creates a significant risk of mess because the tip of the nozzle will almost certainly be coated with flowable additive. Therefore an object of a refinement of this invention is to provide a system which does not require withdrawal of the nozzle in order to permit sealing and subsequent shaking of the container in a conventional paint shaker.

Accordingly this invention further provides a system wherein a) the syringe comprises detachable upper and lower portions, the nozzle being attached to the lower portion,
b) the lower portion can receive the piston and comprises piston retention means for engaging and retaining the received piston within the lower portion,
c) the container comprises a well from which the container inlet leads and which well is dimensioned so as to be able to accommodate the lower portion of the syringe when the nozzle is inserted into the container inlet and
d) the container is provided with lower portion retention means for engaging and retaining the lower portion of the syringe within the well.

By retaining the lower portion of the syringe in the well and by retaining the piston in the lower portion, it is possible to effect a seal of the container inlet after introduction of the additive without exposing the messy tip of the nozzle or providing a temporary opportunity for paint to spill out through the open inlet in the event of the container being accidentally knocked over. Moreover, by detaching the upper portion of the syringe from the retained lower portion, the cumbersome part of the syringe can be removed. It is preferred that the top rim of the retained lower portion should not stand proud of the container so that the container may be easily gripped between the jaws of a conventional paint shaker.

The detachable upper and lower portions of the syringe may be held together by any fluid-tight disengageable means. The preferred means comprises co-operable resilient profiles, one provided on the upper portion and the other on the lower portion which co operate to make a snap fit which can be disengaged by an upwards force exerted on the upper portion. However alternative means such as those used to inhibit unintentional movement of the piston may be employed.

The piston retention means may comprise an interference fit between the circumference of the piston and the walls of the lower portion of the syringe. However a more positive retention is preferred and this is conveniently provided by co-operable snap-fitting resilient profiles, one each provided on the piston and the walls of the lower portion. Preferably the profile on the lower portion comprises a rib and that on the piston comprises a groove.

The lower portion retention means may likewise comprise an interference fit between the lower portion and the well. Alternatively it may comprise co-operating screw-threads provided on the inner face of the well and the outer face of the lower portion. The use of screw threads has the additional advantage of allowing a carefully controlled insertion of the nozzle into the inlet. Again the preferred retention means comprises co-operable snap-fitting resilient profiles one each provided on the lower portion and the well and/or one each provided on the nozzle and in the container inlet. A steadier retention of the lower portion is achieved by use in combination of retaining means which hold the nozzle with retaining means which hold the lower portion in the vicinity of its top rim.

The syringe and container and their components are preferably made from one or more resilient thermoplastics materials such as polyethylene, ethylene copolymer, nylon but especially polypropylene.

BRIEF DESCRIPTION OF THE DRAWINGS

The invention is further illustrated by the following embodiment described with reference to the drawings in which.

DETAILED DESCRIPTION

Figure 1:
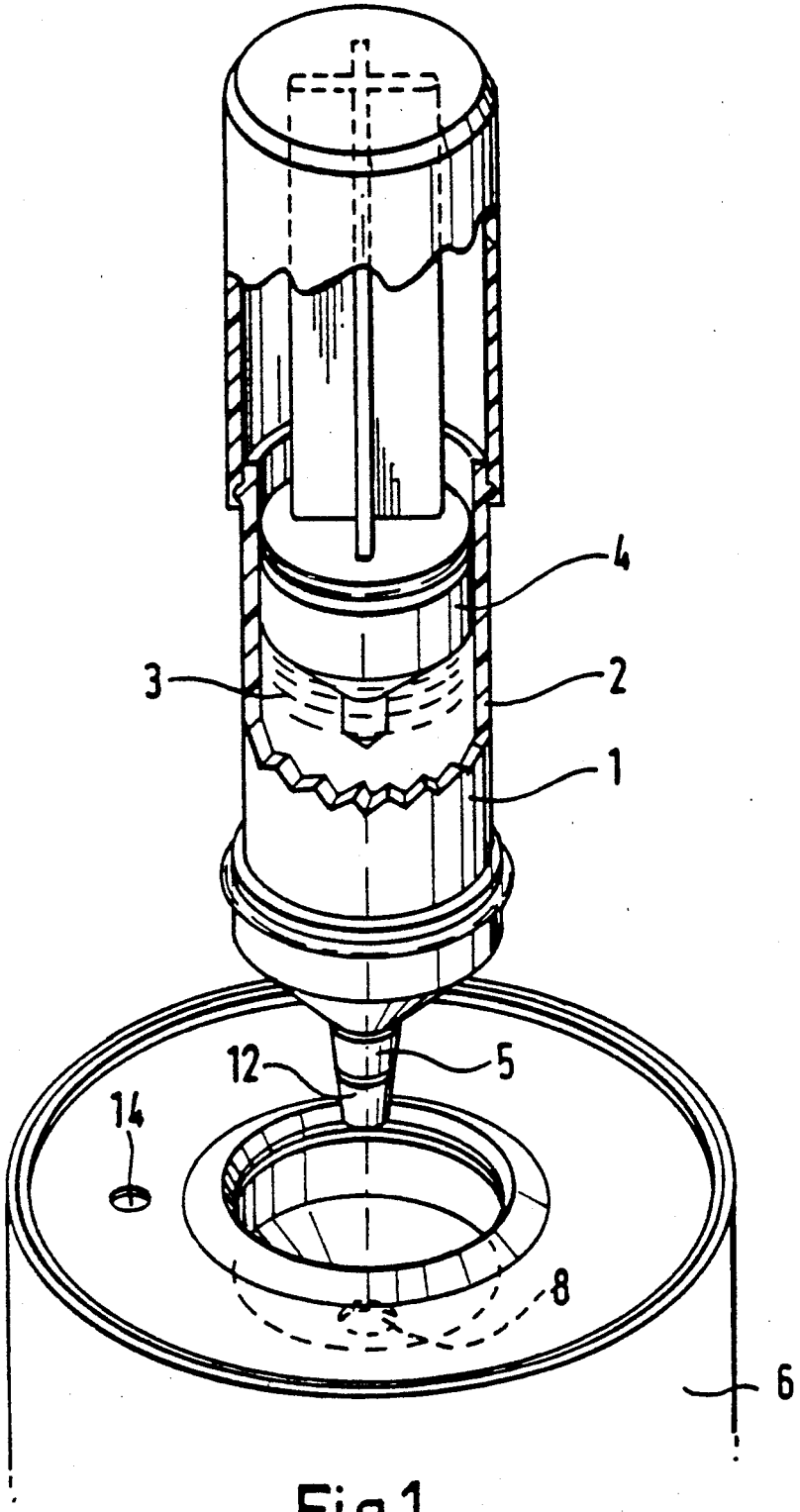
FIG. 1 is a perspective view with part in section of a system according to this invention.
Figure 2:
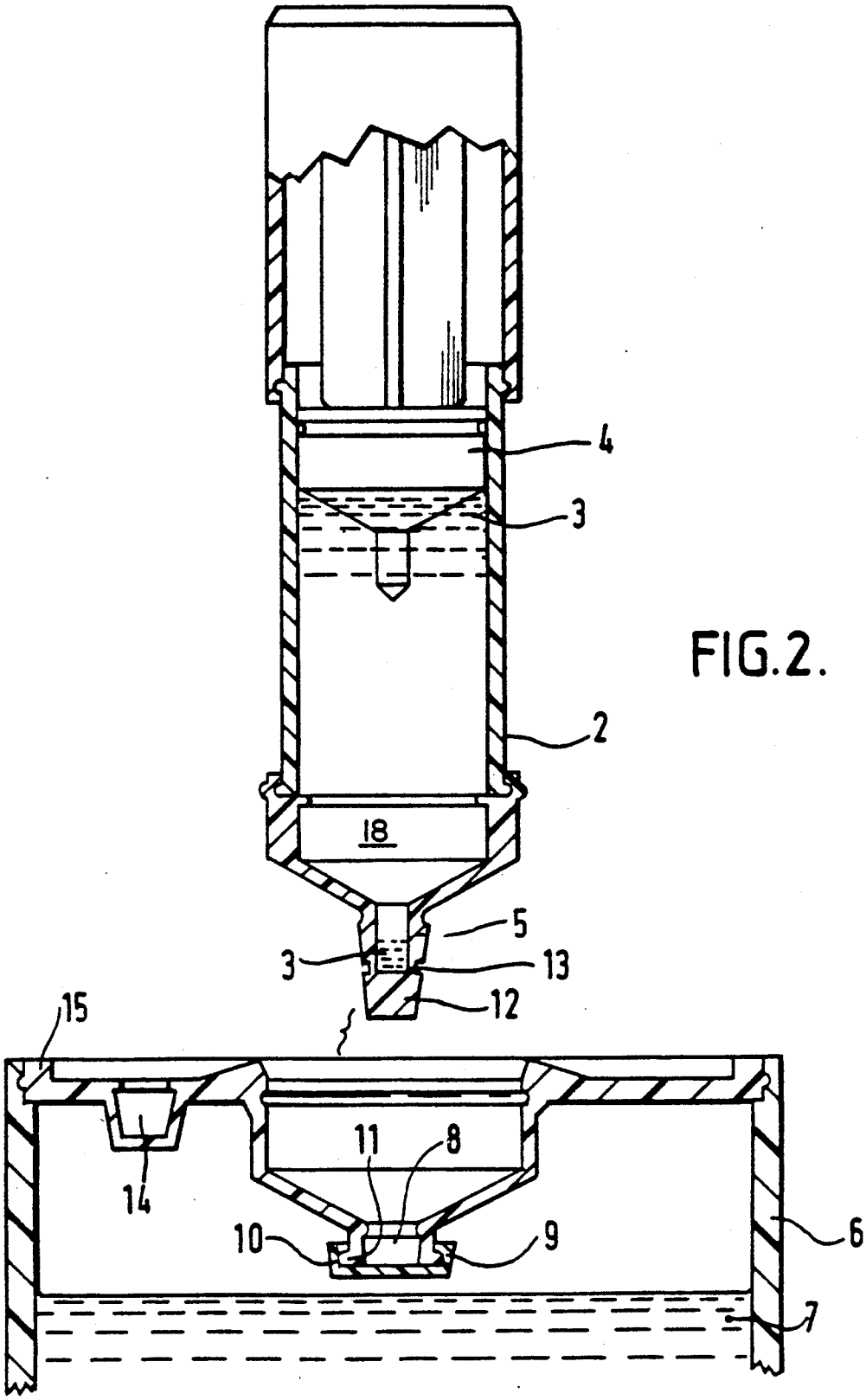
FIG. 2 is a section through the system shown in FIG. 1.

FIG. 1 shows a generally cylindrical polypropylene syringe 1 having a chamber 2 containing viscous fluid additive 3, piston 4 and provided with an outlet nozzle 5. FIG. 1 also shows a polypropylene lidded paint can 6 containing paint 7 (shown in FIG. 2) and provided with an inlet 8 closed by cap 9. Cap 9 is snap fitted onto the tip of inlet 8 by means of circular groove 10 which co-operates with correspondingly profiled annular rib 11 formed on the tip of inlet 8. Inlet 8 can be opened by inwardly displacing cap 9 from off the tip of inlet 8 by insertion of nozzle 5 (after stop 12 has been removed) into inlet 8 as shown in FIG. 6.

Figure 3:
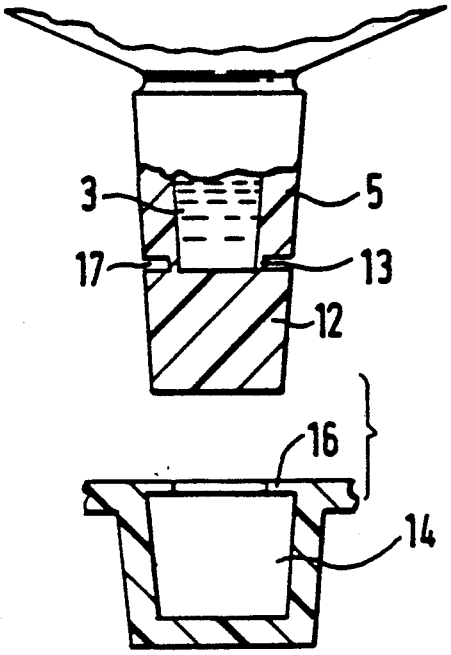
FIG. 3 is a section on a larger scale of the nozzle and shearing means shown in FIG. 2.
Figure 4:
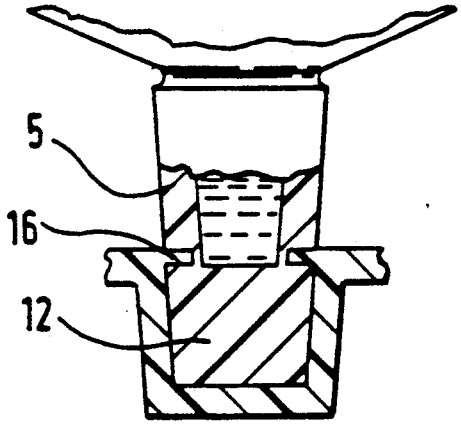
FIG. 4 is a section showing the components of FIG. 3 when mutually engaged.
Figure 5:
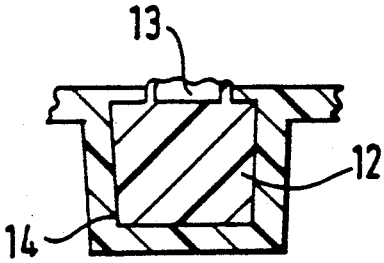
FIG. 5 is a section showing the sheared stopper of FIG. 4.

As shown more clearly in FIG. 3, nozzle 5 is closed by stop 12 frangibly attached to tip 5*a* of nozzle 5 by cylindrical thin web 13. To open nozzle 5, stop 12 is inserted into recess 14 formed in lid 15 of can 6 as shown in FIG. 4. On insertion of stop 12, annular lug 16 engages the annular slot 17 defined by tip 5*a*, web 13 and stop 12 causing stop 12 to be firmly held in recess 14. Web 13 is then easily sheared by sharply tilting syringe 1 relative to can 6. Stop 12 and its sheared web 13 (see FIG. 5) are then left in recess 14.

Figure 6:
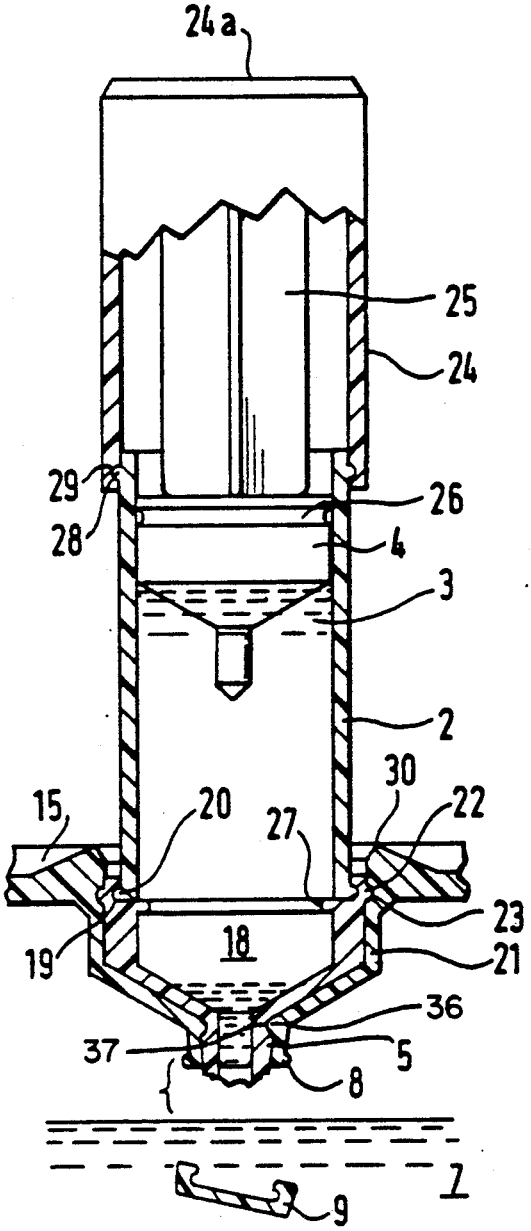
FIG. 6 is a section through the system showing the syringe inserted into the nozzle.

Once nozzle 5 has been opened, it can be inserted into inlet 8 as shown in FIG. 6 whereupon it exerts an inwards force on cap 9 displacing it from the tip of inlet 8 inwardly and downwardly into paint 7. Nozzle 5 is slightly tapered and this helps to guide and locate nozzle 5 in inlet 8. When nozzle 5 is fully inserted, annular rib 36 which extends around the top rim of inlet 8 snap-fits into correspondingly profiled annular groove 37 formed in the top portion of nozzle 5. Rib 36 and groove 37 co-operate to engage and retain nozzle 5 firmly in inlet 8 and to seal inlet 8 against escape of paint 7 or additive 3.

Chamber 2 of syringe 1 terminates in a lower dish 18 which is detachably snap-fit engaged onto chamber 2 by means of circular groove 19 which extends around the upper part of dish 18 and which co-operates with correspondingly profiled circular rib 20 which extends around the base of chamber 2.

Dish 18 is shaped and dimensioned so as to make a close fit into well 21 which depends from lid 15 of container 6 and from which inlet 8 leads. Dish 18 carries annular rib 22 extending around its top part and which snap-fit engages correspondingly profiled annular groove 23 extending around the top part of well 21 in the vicinity of its top rim 30. By positively engaging both the top part of dish 18 and also nozzle 5, it is possible to retain dish 18 very firmly within well 21.

Figure 7:
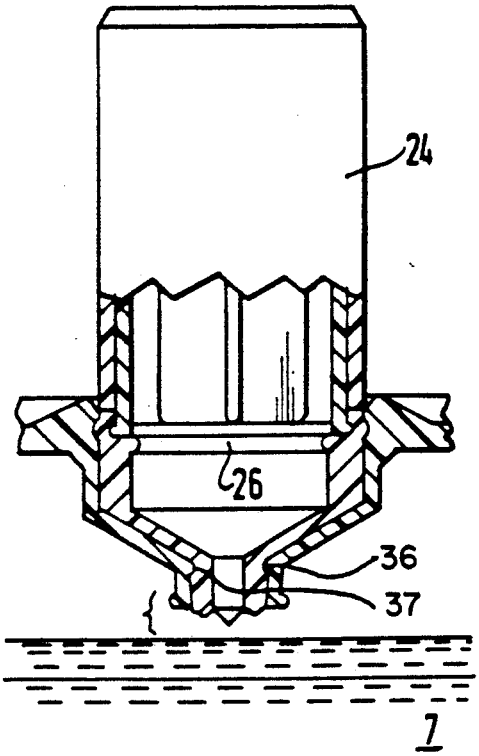
FIG. 7 is a section showing the inserted syringe after expulsion of the additive and FIG. 8 is a section of the container well and lower portion of the syringe and an elevation of the upper portion of the syringe after its detachment from the lower portion.

In order to expel additive 3, syringe 1 is provided with blind telescopable sleeve 24 and cruciform piston rod 25 which rests freely upon piston 4 and is adhesively bonded to the blind end 24*a* of sleeve 24. To expel additive 3, sleeve 24 is depressed thereby driving piston 4 down into dish 18 (as shown in FIG. 7) causing it to expel additive 3 out via nozzle 5 and introduce it into container 6. Piston 4 is shaped like a spinning top so as to allow it to make a close fit in dish 18 whereby efficient expulsion of additive 3 from dish 18 is promoted. On entering dish 18, annular groove 26 formed in piston 4 snap-fit engages correspondingly profiled rib 27 which extends around the top part of dish 18.

Groove 26 and rib 27 co-operate to engage and retain piston 4 within dish 18 so sealing against escape of paint 7 or additive 3. Unintentional depression of sleeve 24 is inhibited by the provision of annular rib 28 around the top portion of chamber 2 and correspondingly profiled annular groove 29 around the lower part of sleeve 24 which co-operate to create a snap-fit engagement which requires a positive effort to disengage.

Figure 8:
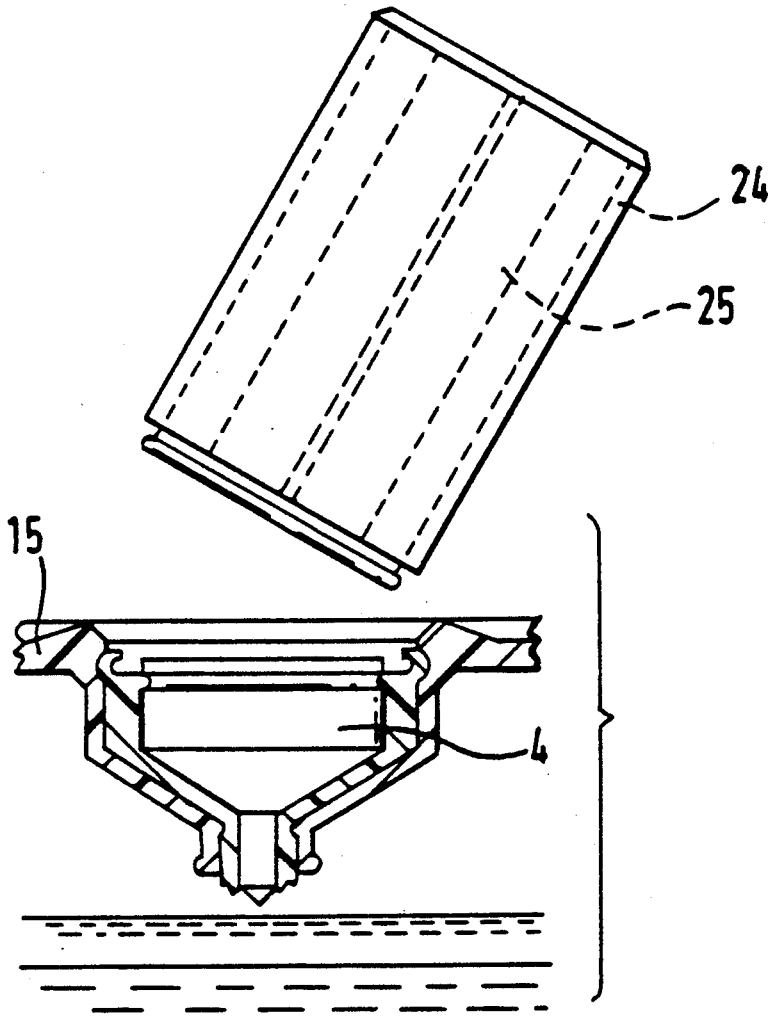

After additive 3 has been introduced into container 6 and piston 4 engaged by rib 27, then sleeve 24, piston rod 25 and chamber 2 can be detached and removed (as shown in FIG. 8) by tilting sleeve 24 relative to dish 18 and jerking it upwards to disengage rib 20 from groove 19. Inlet 8 and dish 18 remain sealed, yet container 6 can be conveniently gripped between the jaws of a conventional paint shaker.

This invention further provides a method for introducing flowable additive to paint, varnish, woodstain or the like in a closed (preferably lidded) container which method comprises:

a) providing the additive in a syringe having a piston for use in expelling the additive from the syringe and a nozzle through which the additive can be expelled,
b) providing the paint, varnish, woodstain or the like in a closed container provided with an inlet closed by a closure but which inlet is openable by insertion of the syringe nozzle into the inlet,
c) inserting the syringe nozzle into the container inlet so as to open the inlet and
d) moving the piston to expel additive from the syringe via the nozzle whereby the additive is introduced into the container.

What is claimed is:

1. A system for introducing a flowable additive into a body of paint, varnish, woodstain or the like contained in a closed container, said system comprising:

a syringe containing a flowable additive and having a piston for use in expelling the additive from the syringe and a nozzle through which the additive can be expelled;

said syringe comprising an upper portion and a lower portion, the upper portion being detachable and removable from the lower portion; the nozzle being attached to the lower portion;

said lower portion being disposed to receive the piston and comprising a piston retention means for engaging and retaining said piston within the lower portion;

a closed container containing a body of paint, varnish, woodstain or the like; said container being provided with an inlet closed by a closure, which inlet is openable by insertion of said syringe nozzle into said inlet;

said container comprising a well from which said container inlet leads;

said well being dimensioned so as to be able to accommodate said lower portion of said syringe when said nozzle is inserted into said container inlet;

said container being provided with a lower portion retention means for engaging and retaining said lower portion of said syringe within said well;

the nozzle and the container inlet being shaped such that the nozzle can make a snap-fit in the inlet.

2. A system for introducing a flowable additive into a body of paint, varnish, woodstain or the like contained in a closed container, said system comprising:

a syringe containing a flowable additive and having a piston for use in expelling the additive from the syringe and a nozzle through which the additive can be expelled;

said syringe comprising an upper portion and a lower portion, the upper portion being detachable and removable from the lower portion; the nozzle being attached to the lower portion;

said lower portion being disposed to receive the piston and comprising a piston retention means for engaging and retaining said piston within the lower portion;

a closed container containing a body of paint, varnish, woodstain or the like; said container being provided with an inlet closed by a closure, which inlet is openable by insertion of said syringe nozzle into said inlet;

said container comprising a well from which said container inlet leads;

said well being dimensioned so as to be able to accommodate said lower portion of said syringe when said nozzle is inserted into said container inlet;

said container being provided with a lower portion retention means for engaging and retaining said lower portion of said syringe within said well;

the closure comprising a cap snap-fitted onto the inlet;

3. A system of introducing a flowable additive into a body of paint, varnish, woodstain or the like contained in a closed container, said system comprising:

a syringe containing a flowable additive and having a piston for use in expelling the additive from the syringe and a nozzle through which the additive can be expelled;

said syringe comprising an upper portion and a lower portion, the upper portion being detachable and removable from the lower portion; then nozzle being attached to the lower portion;

said lower portion being disposed to receive the piston and comprising a piston retention means for engaging and retaining said piston within the lower portion;

a closed container containing a body of paint, varnish, woodstain or the like; said container being provided with an inlet closed by a closure, which inlet is openable by insertion of said syringe nozzle into said inlet;

said container comprising a well from which said container inlet leads;

said well being dimensioned so as to be able to accommodate said lower portion of said syringe when said nozzle is inserted into said container inlet;

said container being provided with a lower portion retention means for engaging and retaining said lower portion of said syringe within said well;

the nozzle being closed by a stop frangibly attached to the nozzle by a thin web.

4. A system for introducing a flowable additive into a body of paint, varnish, woodstain or the like contained in a closed container, said system comprising:

a syringe containing a flowable additive and having a piston for use in expelling the additive from the syringe and a nozzle through which the additive can be expelled;

said syringe comprising an upper portion and a lower portion, the upper portion being detachable and removable from the lower portion; the nozzle being attached to the lower portion;

said lower portion being disposed to receive the piston and comprising a piston retention means for engaging and retaining said piston within the lower portion;

a closed container containing a body of paint, varnish, woodstain or the like; said container being provided with an inlet closed by a closure, which inlet is openable by insertion of said syringe nozzle into said inlet;

said container comprising a well from which said container inlet leads;

said well being dimensioned so as to be able to accommodate said lower portion of said syringe when said nozzle is inserted into said container inlet;

said container being provided with a lower portion retention means for engaging and retaining said lower portion of said syringe within said well;

said lower portion of the syringe and the well in the container are so dimensioned that when retained in the well, said lower portion does not protrude outwardly of the container, whereby, when the upper portion is detached and removed, gripping of the container between the flaws of a paint shaker is facilitated.

5. A system according to claim 4 wherein the lower portion of the syringe is retainable in the well by use in combination of retaining means which hold the nozzle and retaining means which hold the lower portion of the syringe in the vicinity of its top rim.

6. A system according to claim 4 wherein the piston retention means comprises a profile which is engageable with a correspondingly shaped profile provided by the lower portion of the syringe.

7. A system according to claim 4 wherein means for moving the piston, is linked to means disengageably fixed relative to the nozzle whereby movement of the piston relative to the nozzle is impossible without first disengaging the disengageably fixed means.

8. A system for introducing a flowable additive into a body of paint, varnish, woodstain or the like contained in a closed container, said system comprising:

a syringe containing a flowable additive and having a piston for use in expelling the additive from the syringe and a nozzle through which the additive can be expelled;

said syringe comprising an upper portion and a lower portion, the upper portion being detachable and removable from the lower portion; the nozzle being attached to the lower portion;

said lower portion being disposed to receive the piston and comprising a piston retention means for engaging and retaining said piston within the lower portion;

a closed container containing a body of paint, varnish, woodstain or the like; said container being provided with an inlet closed by a closure, which inlet is openable by insertion of said syringe nozzle into said inlet;

said container comprising a well from which said container inlet leads;

said well being dimensioned so as to be able to accommodate said lower portion of said syringe when said nozzle is inserted into said container inlet;

said container being provided with a lower portion retention means for engaging and retaining said lower portion of said syringe within said well;

the nozzle being closed by a stop spaced from the nozzle and sealingly attached thereto by a frangible thin web.

* * * * *